US008590816B2

(12) United States Patent
Ballu

(10) Patent No.: US 8,590,816 B2
(45) Date of Patent: Nov. 26, 2013

(54) SPRAY NOZZLE FOR LIQUID AND DEVICE FOR SPRAYING LIQUID COMPRISING SUCH A NOZZLE

(75) Inventor: Patrick Ballu, Reims (FR)

(73) Assignee: Exel Industries, Epernay (FR)

( * ) Notice: Subject to any disclaimer, the term of this patent is extended or adjusted under 35 U.S.C. 154(b) by 527 days.

(21) Appl. No.: 12/382,368

(22) Filed: Mar. 13, 2009

(65) Prior Publication Data

US 2009/0230221 A1 Sep. 17, 2009

(30) Foreign Application Priority Data

Mar. 14, 2008 (FR) ..... 08 51673

(51) Int. Cl.
*B05B 1/00* (2006.01)

(52) U.S. Cl.
USPC ..... 239/597; 239/589; 239/592; 239/601

(58) Field of Classification Search
USPC ..... 239/568, 589, 592, 595, 597–599, 601, 239/602
See application file for complete search history.

(56) References Cited

U.S. PATENT DOCUMENTS

| | | | | |
|---|---|---|---|---|
| 3,659,787 | A * | 5/1972 | Ito | 239/708 |
| 3,754,710 | A * | 8/1973 | Chimura | 239/597 |
| 5,143,302 | A * | 9/1992 | Sakuma | 239/599 |
| 5,167,371 | A * | 12/1992 | Rohner | 239/597 |
| 5,878,966 | A * | 3/1999 | Asakawa et al. | 239/590 |
| 6,402,062 | B1 * | 6/2002 | Bendig et al. | 239/599 |
| 2007/0069049 | A1 | 3/2007 | Lipthal et al. | |
| 2007/0224358 | A1 | 9/2007 | Insausti-Eciolaza et al. | |

FOREIGN PATENT DOCUMENTS

GB 1 312 052 4/1973

* cited by examiner

*Primary Examiner* — Jason J Boeckmann
(74) *Attorney, Agent, or Firm* — Dowell & Dowell, P.C.

(57) ABSTRACT

A spray nozzle includes a tubular channel extending along a longitudinal axis, a slot formed by two approximately plane surfaces converging in a direction of the channel and located on either side of a plane including the longitudinal axis of the channel, and a dome connecting the channel and the slot wherein a length of the dome represents less than 50% of a largest transverse dimension of the channel and a plane cross section of the dome is symmetric and it is defined by at least two different circular arcs.

12 Claims, 3 Drawing Sheets

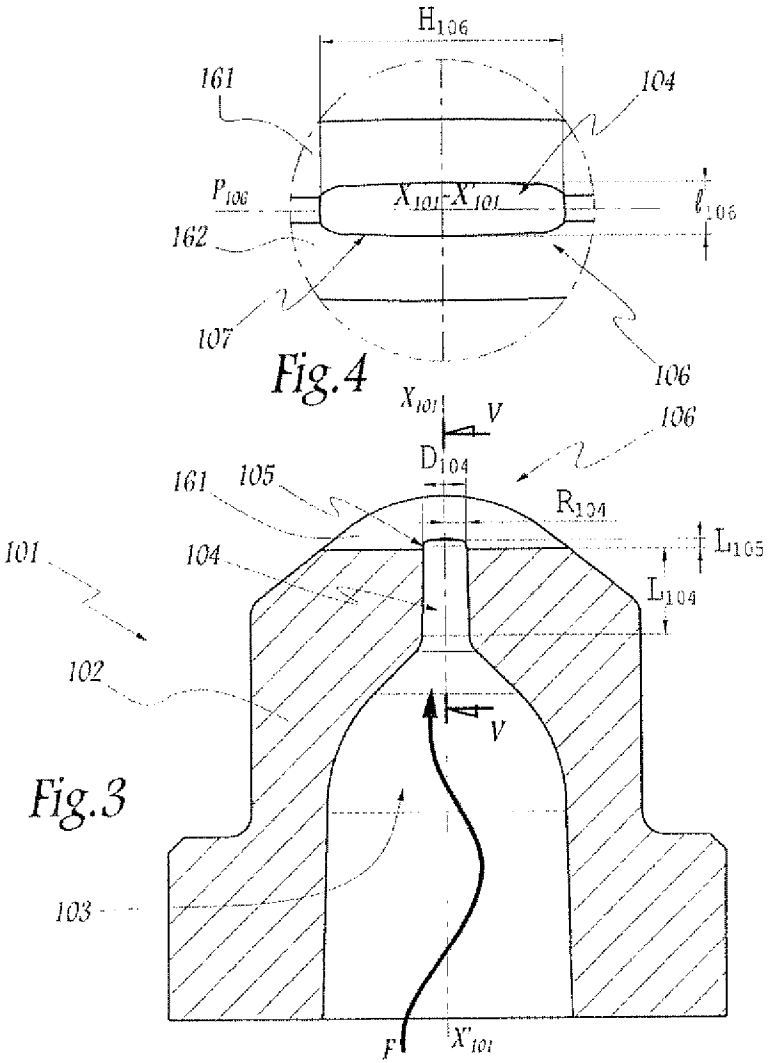
Fig.4
Fig.3
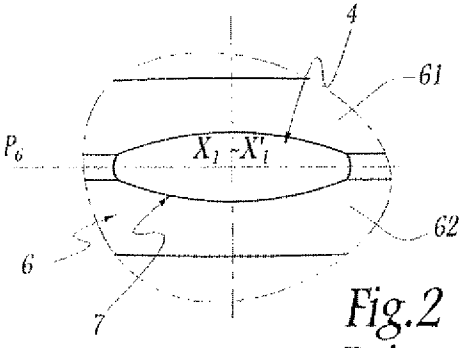
Fig.2
Prior Art
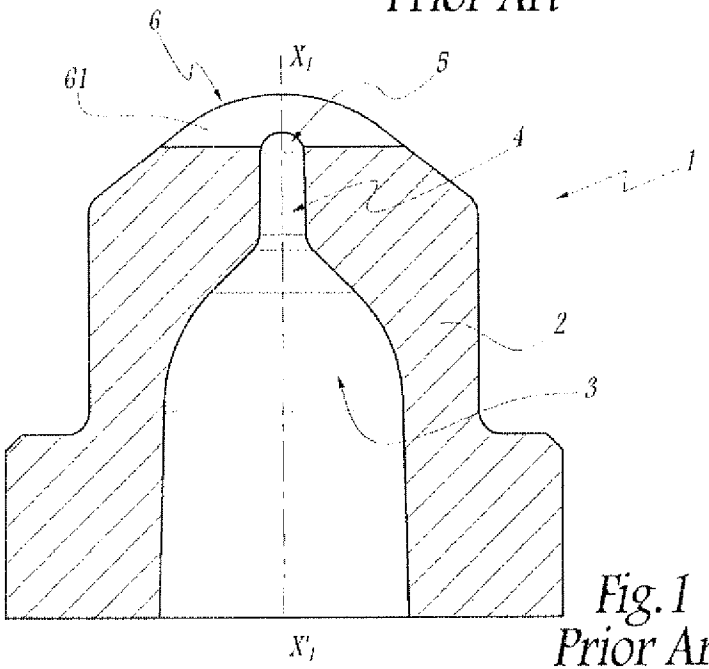
Fig.1
Prior Art

SPRAY NOZZLE FOR LIQUID AND DEVICE FOR SPRAYING LIQUID COMPRISING SUCH A NOZZLE

BACKGROUND OF THE INVENTION

1. Field of the Invention

The present invention relates to a spray nozzle for liquid, in particular for coating liquid under high pressure. Furthermore, the invention relates to a device for spraying liquid, in particular for coating liquid under high pressure, comprising such a nozzle.

2. Brief Description of the Related Art

A device for spraying liquid or sprayer, either of the manual type or of the automatic type, generally comprises a spray nozzle, sometimes several, which is(are) mounted at the downstream end of the sprayer. The terms "upstream" and "downstream" herein refer to the direction of flow of the liquid in the sprayer. The term "upstream" denotes elements located on the side of the sprayer where the liquid to be sprayed arrives from a supply source. The term "downstream" denotes elements located on the side of the sprayer where the liquid is sprayed in droplets.

Such a sprayer may, for example, be intended for spraying coating liquids such as waterborne or solvent-based paints. To produce the spraying of the liquid in droplets, the sprayer is connected, by means of one of more tube(s), to a pump designed to put the liquid under high pressure, for example 70 bars. The spraying is carried out at the downstream end of the nozzle, which has a geometry determined depending on the desired shape for the jet of droplets of the sprayed liquid.

To the aim of shaping the jet of sprayed liquid into a "fan", usually called a "flat" spray, a nozzle such as that illustrated by FIGS. 1 and 2 is known from the prior art. As FIG. 1 shows, the nozzle 1 comprises a body 2 which defines, on the upstream side, a chamber 3 through which the liquid arrives and, on the downstream side, a channel 4 for conveying the liquid from the chamber 3 through to the outlet of the nozzle 1. The chamber 3 and the channel 4 extend along a longitudinal axis $X_1$-$X'_1$ of the nozzle 1. Downstream of the channel 4, the nozzle 1 comprises a slot 6 intended to shape the liquid jet into a flat spray. As FIGS. 1 and 2 show, the slot 6 is formed by two surfaces 61 and 62 which are plane, which converge in the direction of the channel 4, and which are positioned on either side of a plane $P_6$ including axis $X_1$-$X'_1$. The one-eyed bottom of the channel 4 obtained in the body 2 before milling the slot 6 has the form of a hollow dome 5, which is herein referred to by the word "dome". The dome 5 connects the channel 4 and the slot 6.

In nozzles of the prior art, the dome 5 has the shape of an ogive or triangular arch or a hemispherical shape, the length of which approximately equals the diameter of the channel 4. As FIG. 2 shows, the intersection of the dome 5 with the surfaces 61 and 62 of the slot 6 defines an outlet orifice 7 of the nozzle 1 in the overall shape of a flattened ellipse.

When the nozzle 1 sprays a liquid under high pressure, for example 70 bars, the geometry of the orifice 7 shapes the jet into a cone with an elliptical cross section. With the nozzle 1, the flow rate of the sprayed liquid is not uniformly distributed in this elliptical cross section. On the contrary, it has higher concentrations towards the distant edges of the ellipse. In the field of spraying coating liquids, this type of distribution of liquid is called the "tails effect". It has been observed that the more rounded the edges of the ellipse are, the larger are the "tails" in the flow of liquid.

The "tails effect" has the drawback of leading to asymmetric wear of the nozzle 1, by overwearing down the edges of the orifice 7. The more abrasive the sprayed liquid is, the greater this wear is. This wear increases the "tails effect" and therefore leads to a reduction in the quality of the spraying. In addition, it reduces the service life of the nozzle 1, even when the material of the body 2 has a high hardness.

GB-A-1 312 052 describes a flat spray nozzle comprising a discontinuity at the junction between the channel and the dome connecting the channel and the slot of the nozzle. However, the nozzle of GB-A-1 312 052 does not permit to significantly decrease the "tails effect" so as to get a sufficient spraying quality.

SUMMARY OF THE INVENTION

The present invention aims in particular to solve these drawbacks by proposing a spray nozzle with a longer service life and enabling a flat jet to be produced with a relatively uniform distribution of liquid, and therefore to improve the spraying quality.

To this aim, the subject-matter of the invention is a spray nozzle for liquid, in particular for coating liquid under high pressure, comprising:

- a tubular channel for channelling said liquid, said channel extending along a longitudinal axis;
- a slot for shaping a jet of liquid coming from said channel, said slot being formed by two approximately plane surfaces, said surfaces converging in the direction of said channel and being positioned on either side of a plane comprising said longitudinal axis of said channel; and
- a dome connecting said channel and said slot;

The length of said dome, measured parallel to said longitudinal axis, represents less than 50%, preferably between 20% and 45%, of the largest transverse dimension of said channel, measured in a plane that is orthogonal to said longitudinal axis.

Said dome has a plane cross section that is symmetric relative to said longitudinal axis. Said plane cross section is defined by at least two circle arcs which extend between a downstream end portion of said channel and said longitudinal axis and which have different radii and centers located on the side of said channel.

According to other advantageous, but optional, features of the invention, taken in isolation or in any technically feasible combination:

- said plane cross section is defined by three circle arcs which extend between said downstream end portion of said channel and said longitudinal axis and which have different radii and centers located on the side of said channel;
- a first circle arc close to said downstream end portion of said channel has a radius less than half of the smallest dimension of said channel, measured in a plane orthogonal to said longitudinal axis, the circle arc the furthest from said downstream end portion of said channel having a radius greater than half the largest dimension of said channel, measured in a plane orthogonal to said longitudinal axis, and each other circle arc having a radius of a size greater than the radius of the preceding circle arc and less than the radius of the following circle arc;
- said first circle arc is tangent to said downstream end portion of said channel and each other circle arc is tangent to the preceding circle arc;
- said channel has a cylindrical form with a circular base, said dome has a rotational symmetry about said longitudinal axis of said channel;

the dimensions of said channel, measured in a plane that is orthogonal to said longitudinal axis, are between 0.1 mm and 1.8 mm;

said slot has a height of between 0.2 mm and 2 mm and a width of between 0.02 mm and 1.6 mm;

said surfaces form an angle of between 10° and 110° between them;

said nozzle is made of a material having a hardness greater than 50 on the Rockwell C scale, this material being able to be selected from the group comprising the tungsten carbides and the ceramics.

Furthermore, the subject-matter of the invention is a device for spraying liquid, in particular coating liquid under high pressure, characterized in that it comprises a nozzle such as disclosed above.

BRIEF DESCRIPTION OF THE DRAWINGS

The invention will be well understood, and its advantages will become apparent, in the light of the following description, provided only by way of non limiting example and with reference to the annexed drawings, in which:

FIG. 1 is a cross section of a spray nozzle of the prior art;

FIG. 2 is a partial view from above, at a larger scale, of the spray nozzle illustrated in FIG. 1;

FIG. 3 is a cross section similar to that of FIG. 1 of a spray nozzle according to a first embodiment of the invention;

FIG. 4 is a view similar to that of FIG. 2 of the nozzle illustrated in FIG. 3;

DESCRIPTION OF THE PREFERRED EMBODIMENT

Figure 8:
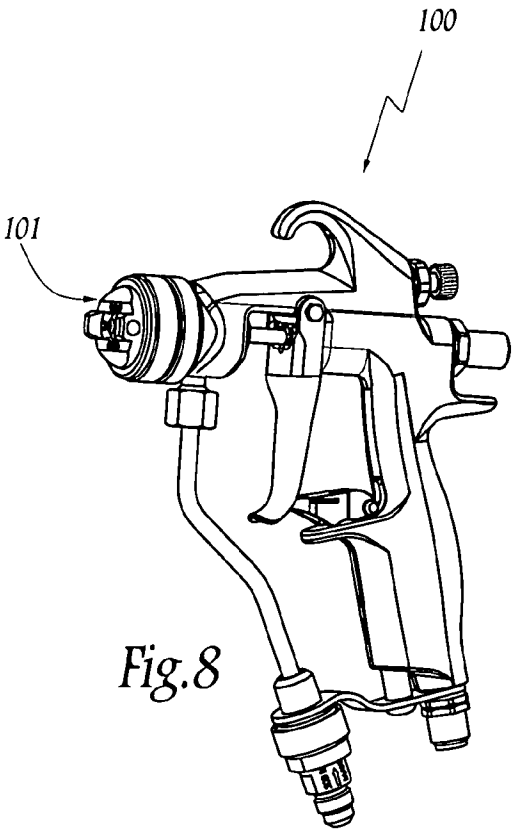
FIG. 8 is a perspective view of a spraying device according to the invention comprising a nozzle according to the invention.

As FIG. 3 shows, the nozzle 101 comprises a body 102 which defines, on the upstream side, a chamber 103 through which the liquid arrives and, on the downstream side, a channel 104 for conveying the liquid from the chamber 103 through to the outlet of the nozzle 101. The direction of flow of the fluid through the nozzle 101 is represented by an arrow F, which then allows to notice the upstream and downstream sides of the nozzle 101.

The chamber 103 and the channel 104 extend along a longitudinal axis $X_{101}$-$X'_{101}$ of the nozzle 101. In the example of FIG. 3, the channel 104 has the overall form of a cylinder with an axis $X_{101}$-$X'_{101}$ and a circular base of diameter $D_{104}$. Downstream of the channel 104, the nozzle 101 comprises a slot 106 intended to shape the liquid jet into a flat spray. As FIGS. 3 and 4 show, the slot 106 is formed by two surfaces 161 and 162 which are plane, which converge in the direction of the channel 104, and which are positioned on either side of a plane $P_{106}$ comprising the axis $X_{101}$-$X'_{101}$.

The nozzle 101 furthermore comprises a dome 105 connecting the channel 104 and the slot 106. "Dome" denotes the one-eyed base of the channel 104, which is obtained in the body 102 before milling the slot 106. "Connecting" means bringing into fluid communication.

The length $L_{105}$ of the dome 105, measured parallel to the longitudinal axis $X_{101}$-$X'_{101}$, here represents 25% of the diameter $D_{104}$ of the channel 104. In practice, the length $L_{105}$ of the dome 105 represents less than 50%, preferably between 20% and 45%, of the diameter $D_{104}$ of the channel 104. In other words, the dome 105 has a short or flattened shape in relation to the dome 5 of the nozzle 1 of the prior art illustrated in FIG. 1.

The tubular channel of the nozzle subject-matter of the invention may, as a variant, be prismatic in shape or be in a cylindrical shape with a non-circular base, for example an elliptical base. In this case too, the length of the dome is less than 50%, preferably between 20% and 45%, of the largest transverse dimension of the channel, measured in a plane orthogonal to the longitudinal axis of the nozzle.

The dome 105 has rotational symmetry around the axis $X_{101}$-$X'_{101}$. A cross section of the dome 105 through a plane containing the axis $X_{101}$-$X'_{101}$, for example through the plane $P_{106}$, is defined by two circle arcs $C_{1051}$ and $C_{1052}$ that extend between a downstream end portion 1041 of the channel 104 and the axis $X_{101}$-$X'_{101}$. The circle arcs $C_{1051}$ and $C_{1052}$ have the respective radii $R_{1051}$ and $R_{1052}$ and respective centres $O_{1051}$ and $O_{1052}$ located on the side of the channel 104, i.e. opposite the downstream portion of slot 106.

Figure 5:
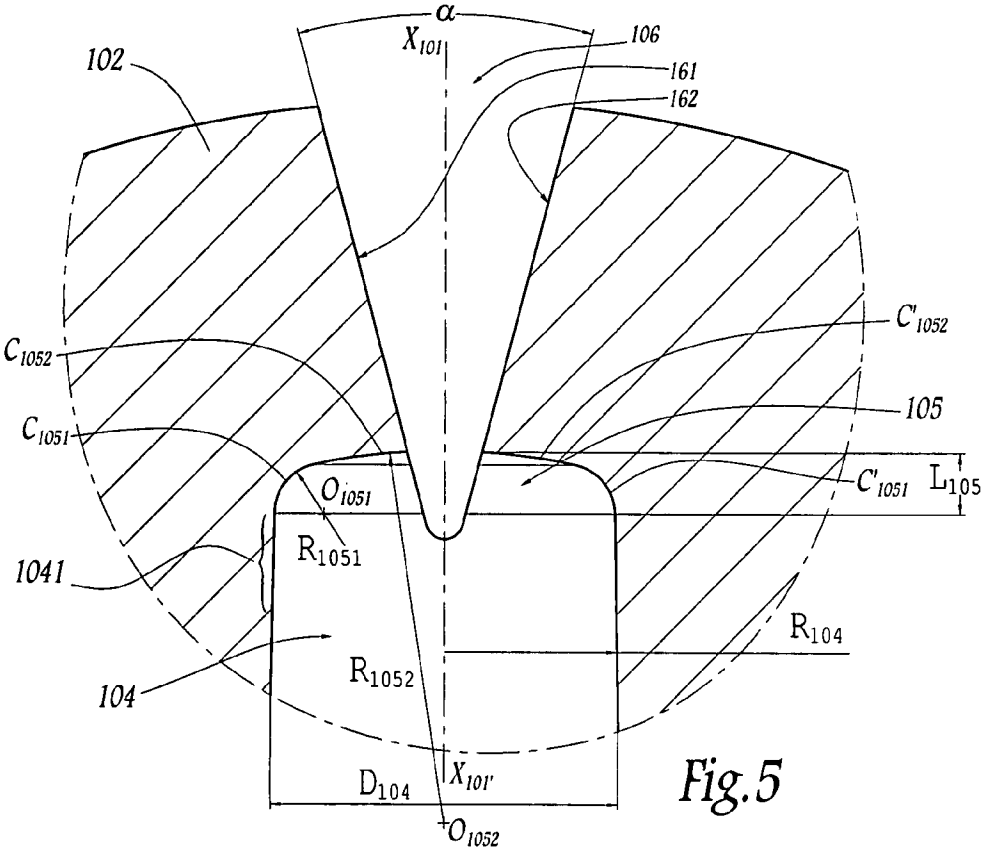
FIG. 5 is a partial cross section, at a larger scale, along the line V-V of FIG. 4.

On the right-hand part of FIG. 5, the two arcs $C'_{1051}$ and $C'_{1052}$ extend between the end portion 1041 of the channel 104 and the axis $X_{101}$-$X'_{101}$, symmetrically with the arcs $C_{1051}$ and $C_{1052}$ relative to the axis $X_{101}$-$X'_{101}$. The radius $R_{1051}$ is relatively small compared with the radius $R_{1052}$. Thus, the radius $R_{1051}$ is less than half the diameter $D_{104}$, which represents both the smallest and the largest transverse dimension of the channel 104. "Transverse" denotes a dimension measured in a plane orthogonal to the longitudinal axis $X_{101}$-$X'_{101}$. Conversely, the radius $R_{1052}$ is greater than half the diameter $D_{104}$ of the channel 104.

In addition, the circle arc $C_{1051}$ is tangent to the end portion 1041 of the channel 104 and the circle arc $C_{1052}$ is tangent to the circle arc $C_{1051}$. Thus the arcs $C_{1051}$ and $C_{1052}$ are joined in a continuous manner and without any singularity. By symmetry, the geometry of the arcs $C'_{1051}$ and $C'_{1052}$ is identical to that of the arcs $C_{1051}$ and $C_{1052}$. The dome 105 thus has a shape that is overall trapezoidal or a shape of half a convex lens.

The shape of the dome 105 may be comprised of more than two circle arcs joined to each other. In such a case, the radius of the circle arc closest to the downstream end portion of the channel is less than half the largest transverse dimension of the channel, the radius of the circle arc furthest from the downstream end portion of the channel is greater than half the largest transverse dimension of the channel; and each other circle arc has a radius of a size greater than the radius of the preceding circle arc and less than the radius of the following circle arc. In addition, in such a case, each circle arc is tangent to the preceding circle arc.

In the example of FIGS. 3 to 5, the slot 106 has a height $H_{106}$ of around 0.55 mm and a width $l_{106}$ of around 0.12 mm. The height $H_{106}$ is considered in the direction defined by the intersection of the plane $P_{106}$ with the plane of FIG. 4 and the width $l_{106}$ is measured in the plane of FIG. 4 and perpendicular to the plane $P_{106}$. In practice, the height $H_{106}$ may be between 0.2 mm and 2 mm and the width $l_{106}$ may be between 0.02 mm and 1.6 mm. As FIG. 5 shows, the surfaces 161 and 162 form an angle $\alpha$ of around 30° between them. In practice, the angle $\alpha$ may be between 10° and 110°.

The channel 104 has a length $L_{104}$, measured along the axis $X_{101}$-$X'_{101}$, of around 1.1 mm. In practice, the length $L_{104}$ may be between 0.4 mm and 3.5 mm. Moreover, the diameter $D_{104}$ of the channel 104 has a value of around 0.55 mm and may in practice be between 0.1 mm and 1.8 mm.

As FIG. 4 shows, the intersection of the "flattened" or "short" dome 105 with the plane surfaces 161 and 162 that form the slot 106 defines an outlet orifice 107 that is approximately rectangular in shape with rounded corners. To the extent that the surfaces 161 and 162 are symmetric in relation to the plane $P_{106}$ and the dome 105 has a symmetry with the axis $X_{101}$-$X'_{101}$, the orifice 107 has, in the elevation of FIG. 4, a symmetry by quadrants, the center of which is at the intersection of the plane $P_{106}$, of the axis $X_{101}$-$X'_{101}$ and of the plane of FIG. 4.

The geometry and the dimensions of the nozzle 101, in particular of its flattened dome 105, define the approximately rectangular shape of the outlet orifice 107. Such a nozzle enables to considerably reduce the "tails effect", hence to render the liquid flow rate more uniform in the jet sprayed under, for example, 70 bars, or even under lower pressure, for example 40 bars. To the extent that this sprayed jet is more uniform, the quality of the spraying, hence of the application of this jet for example the coating of an object, is significantly improved. In addition, as the "tails effect" is reduced, the wearing of the edges of the outlet orifice 107 of a nozzle 101 according to the invention is greatly reduced, thereby increasing the service life of the nozzle 101.

Figure 7:
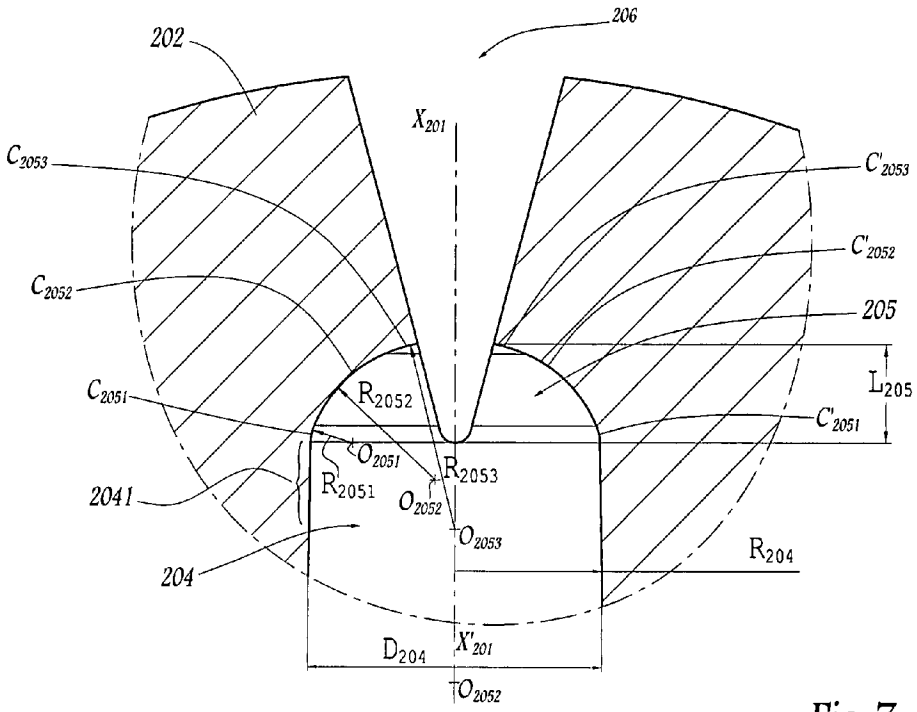
FIG. 7 is a view similar to that of FIG. 5 of the nozzle partially illustrated in FIG. 6.
Figure 6:
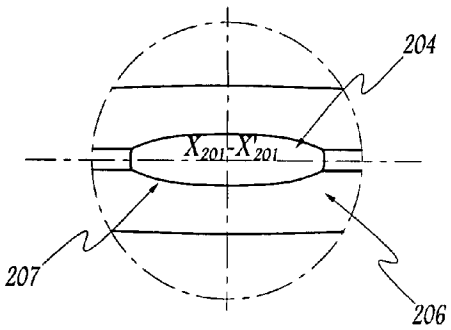
FIG. 6 is a view similar to that of FIG. 4 of a spray nozzle according to a second embodiment of the invention.

The description of FIGS. 4 and 5 given above can be directly transposed to FIGS. 6 and 7, except the hereafter stated differences. An element of FIG. 6 or 7 similar or corresponding to an element of FIG. 4 or 5 gets the same numerical reference with prefix 2 replacing prefix 1.

One thus defines a nozzle 201, a longitudinal axis $X_{201}$-$X'_{201}$, a body 202, a channel 204 with a diameter $D_{204}$ and a radius $R_{204}$, a dome 205 with a length $L_{205}$, a slot 206 with an outlet orifice 207, circle arcs $C_{2051}$ and $C_{2052}$ with respective radii $R_{2051}$ and $R_{2052}$ and respective centers $O_{2051}$ and $O_{2052}$ and a downstream end portion 2041.

The nozzle 201 differs from the nozzle 101, because the plane cross section of the dome 205 is defined by three circle arcs $C_{2051}$, $C_{2052}$ and $C_{2053}$, instead of two for the dome 105. Alike the plane cross section of FIG. 5, the plane cross section of FIG. 7 is symmetric with respect to longitudinal axis $X_{201}$-$X'_{201}$. Thus, on the right-hand part of FIG. 7, three arcs $C'_{2051}$, $C'_{2052}$ and $C'_{2053}$ extend between the end portion 2041 of the channel 204 and axis $X_{201}$-$X'_{201}$, symmetrically with the arcs $C_{2051}$, $C_{2052}$ and $C_{2053}$ relative to the axis $X_{201}$-$X'_{201}$.

The radius $R_{2053}$ is greater than the radius $R_{2052}$, the latter being itself greater than the radius $R_{2051}$. Furthermore, the radius $R_{2051}$ is less than the radius $R_{204}$ of the channel 204 and the radius $R_{2053}$ is greater than the radius $R_{204}$.

The geometry and the dimensions of the nozzle 201, in particular of its dome 205, permit to further decrease the "tails effect", hence to render more uniform the liquid flow rate in the sprayed jet, with respect to nozzle 101.

FIG. 8 illustrates a sprayer 100 or device for spraying liquid, in particular coating liquid under high pressure, comprising a nozzle 101 according to the invention. The sprayer 100 therefore produces sprays of improved quality and relatively uniform. In addition, the sprayer 100 requires fewer operations for replacing the nozzle 101.

To the aim of further increasing the service life of the nozzle 101, the latter may be made of a material having a high hardness, which may be selected from the group comprising the tungsten carbides and the ceramics or any other material having a high hardness. A high hardness means a hardness greater than 50 on the Rockwell C scale.

The invention claimed is:

1. A spray nozzle for spraying liquid under high pressure, comprising:

a body having a tubular channel for channeling liquid to a downstream end portion thereof, the channel extending along a longitudinal axis;

a slot for shaping a jet of liquid coming from the channel, the slot being formed by two approximately plane surfaces, the plane surfaces converging toward one another in a direction of the channel and being located on either side of a plane including the longitudinal axis of the channel;

a dome connecting the downstream end portion of the channel and the slot, a length of the dome, measured parallel to the longitudinal axis, being less than 50% of a largest cross sectional transverse dimension of the channel as measured in a plane that is orthogonal to the longitudinal axis, the dome having a plane cross section that is symmetric relative to the longitudinal axis, the plane cross section being defined by a plurality of circular arcs including at least three circular arcs which successively extend from the downstream end portion of the channel and toward the slot and which have different radii extending from spaced centers located within the channel, a first of the at least three circular arcs extends from the downstream end portion of the channel and toward the longitudinal axis and has a first radius, a second of the three circular arcs extends between the first circular arc toward but spaced from the slot and has a second radius which is greater than the first radius, and a third circular arc extends between the second circular arc to the slot and has a third radius which is greater than the second radius, and wherein the first circular arc which extends from the downstream end portion of the channel has a radius which is equal to less than half of a smallest cross sectional transverse dimension of the channel, measured in a plane orthogonal to the longitudinal axis, and the third circular arc which extends to the slot has a radius greater than half the largest cross sectional transverse dimension of the channel, measured in a plane orthogonal to the longitudinal axis, whereby a size of the radii of the plurality of circular arcs increases for each circular arc provided between the first circular arc and the slot.

2. The spray nozzle of claim 1, wherein the first circle arc is tangent to the downstream end portion of the channel and in that each additional circular arc including the second and third circular arcs is tangent to an adjacent preceding circular arc.

3. The spray nozzle of claim 1, wherein the channel has a cylindrical form with a circular cross section and in that the dome has a rotational symmetry about the longitudinal axis of the channel.

4. The spray nozzle of claim 1, wherein cross sectional dimensions of the channel, measured in a plane that is orthogonal to the longitudinal axis, are between 0.1 mm and 1.8 mm.

5. The spray nozzle of claim 1, wherein the slot has a height of between 0.2 mm and 2 mm and a width of between 0.02 mm and 1.60 mm.

6. The spray nozzle of claim 1, wherein the plane surfaces form an angle of between 10° and 110° between them.

7. The spray nozzle of claim 1, wherein the body is made of a material having a hardness greater than 50 on the Rockwell C scale.

8. A device for spraying liquid under high pressure including a spray nozzle according to claim 1.

9. The spray nozzle of claim 7 wherein the material is selected from a group of materials consisting of tungsten carbides and ceramics.

10. The spray nozzle of claim 1 wherein the length of the dome, measured parallel to the longitudinal axis, is between 20% and 45%, of the largest cross sectional transverse dimension of the channel as measured in a plane that is orthogonal to the longitudinal axis.

11. The spray nozzle of claim 10 wherein the channel is cylindrical and the largest cross sectional transverse dimension is a diameter of the cylindrical channel.

12. The spray nozzle of claim 1 wherein a size of the radii of the plurality of circular arcs increases for each additional circular arc provided progressively toward the third circular arc.

* * * * *